US010941021B2

(12) United States Patent
Zhao et al.

(10) Patent No.: US 10,941,021 B2
(45) Date of Patent: Mar. 9, 2021

(54) SHEAVE FOR BELT WITH PROFILE TRACKING FEATURES

(71) Applicant: Otis Elevator Company, Farmington, CT (US)

(72) Inventors: Wenping Zhao, Glastonbury, CT (US); Daniel A. Mosher, Glastonbury, CT (US); Walter Thomas Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 222 days.

(21) Appl. No.: 15/687,805

(22) Filed: Aug. 28, 2017

(65) Prior Publication Data

US 2019/0062120 A1 Feb. 28, 2019

(51) Int. Cl.
*B66B 15/04* (2006.01)
*B66B 7/06* (2006.01)

(52) U.S. Cl.
CPC ..... *B66B 15/04* (2013.01); *B66B 7/062* (2013.01)

(58) Field of Classification Search
CPC ..... B66B 7/062; B66B 15/04; F16H 7/023; F16H 55/36
See application file for complete search history.

(56) References Cited

U.S. PATENT DOCUMENTS 3,948,113 A * 4/1976 Stork ..... B29D 29/103 474/148
4,591,025 A 5/1986 Honda
4,840,607 A 6/1989 Hitchcock et al.
5,055,090 A * 10/1991 Miranti, Jr. ..... F16G 1/28 474/249
5,308,291 A 5/1994 Robertson et al.
5,492,507 A 2/1996 Kumazaki
(Continued)

FOREIGN PATENT DOCUMENTS

CN 101044084 A 9/2007
CN 100590055 C 2/2010
(Continued)

OTHER PUBLICATIONS

CN106081793 English Translation.*
(Continued)

*Primary Examiner* — Minh Truong
(74) *Attorney, Agent, or Firm* — Cantor Colburn LLP

(57) ABSTRACT

A belt and sheave assembly for an elevator system includes a sheave having a plurality of tracking grooves laterally spaced across a sheave width, and a debris channel located in a tracking groove of the plurality of tracking grooves defining a radially inwardmost extent of the tracking groove. The assembly further includes a belt having a plurality of tension members arranged along a belt width and extending longitudinally along a length of the belt, a jacket at least partially enclosing the tension members, the jacket defining a side of the belt configured to interface with the sheave, and a plurality of tracking features extending from the side of the belt. The tracking features are laterally spaced across the belt width. Each tracking feature is configured to be received in a tracking groove, and each tension member is laterally offset from each of the tracking features.

15 Claims, 6 Drawing Sheets

(56) References Cited

U.S. PATENT DOCUMENTS

| | | | | |
|---|---|---|---|---|
| 7,757,817 | B2 * | 7/2010 | Ach | B66B 7/062 187/251 |
| 7,882,935 | B2 * | 2/2011 | Ach | B66B 7/062 187/251 |
| 2007/0060430 | A1 | 3/2007 | Alden et al. | |
| 2008/0116014 | A1 * | 5/2008 | Ach | B66B 7/062 187/252 |
| 2008/0135343 | A1 * | 6/2008 | Ach | B66B 7/062 187/266 |
| 2008/0314691 | A1 | 12/2008 | Mustalahti et al. | |
| 2010/0184547 | A1 * | 7/2010 | Clarke | F16H 7/023 474/152 |
| 2012/0211310 | A1 | 8/2012 | Peric et al. | |
| 2015/0101888 | A1 | 4/2015 | Pelto-Huikko | |
| 2018/0186604 | A1 * | 7/2018 | Helenius | D07B 1/165 |
| 2019/0023535 | A1 * | 1/2019 | Valjus | B66B 7/062 |
| 2019/0077634 | A1 * | 3/2019 | Narendar | B66B 7/062 |

FOREIGN PATENT DOCUMENTS

| | | | |
|---|---|---|---|
| CN | 201567140 | U | 9/2010 |
| CN | 101122097 | B | 11/2011 |
| CN | 203333120 | U | 12/2013 |
| CN | 104555658 | A | 4/2015 |
| CN | 104930120 | A | 9/2015 |
| CN | 205472184 | U | 8/2016 |
| CN | 105923503 | A | 9/2016 |
| CN | 205602902 | U | 9/2016 |
| CN | 106081793 | A | 11/2016 |
| DE | 102005030255 | A1 | 1/2007 |
| DE | 202008001786 | U1 | 12/2008 |
| EP | 1777189 | A1 | 4/2007 |
| EP | 1886957 | A1 | 2/2008 |
| EP | 2829498 | A1 | 1/2015 |
| GB | 1184997 | A | 3/1970 |
| JP | 4580828 | B2 | 11/2010 |
| JP | 201386887 | A | 5/2013 |
| WO | 2006042427 | A1 | 4/2006 |
| WO | 2012162853 | A1 | 12/2012 |
| WO | 2013110853 | A1 | 8/2013 |
| WO | 2017032675 | A1 | 3/2017 |

OTHER PUBLICATIONS

European Search Report Issued in EP Application No. 18190835.1, dated Jan. 31, 2019, 11 Pages.

Chinese Office Action Issued in CN Application No. 201810984381.X; dated Feb. 7, 2020; 13 Pages.

* cited by examiner

SHEAVE FOR BELT WITH PROFILE TRACKING FEATURES

BACKGROUND

Embodiments disclosed herein relate to elevator systems, and more particularly to load bearing members to suspend and/or drive elevator cars of an elevator system.

Elevator systems are useful for carrying passengers, cargo, or both, between various levels in a building. Some elevators are traction based and utilize load bearing members such as belts for supporting the elevator car and achieving the desired movement and positioning of the elevator car.

Where a belt is used as a load bearing member, a plurality of tension members are embedded in a common jacket. The jacket retains the tension members in desired positions and provides a frictional load path. In an exemplary traction elevator system, a machine drives a traction sheave with which the belts interact to drive the elevator car along a hoistway. Belts typically utilize tension members formed from steel elements, but alternatively may utilize tension members formed from synthetic fibers or other materials, such as carbon fiber composites.

In many elevator systems, multiple belts are utilized as load bearing members, and are routed laterally adjacently over the traction sheave. One challenge is providing enough strength and stiffness per sheave width for the system, and an important element of this is how closely the belts can be positioned. The belt positioning is affected by the accuracy of belt tracking which can be affected not only by machine sheave alignment but also by hoistway rail positioning and building sway or drift.

BRIEF DESCRIPTION

In one embodiment, a belt and sheave assembly for an elevator system includes a sheave having a plurality of tracking grooves laterally spaced across a sheave width, and a debris channel located in a tracking groove of the plurality of tracking grooves defining a radially inwardmost extent of the tracking groove. The assembly further includes a belt having a plurality of tension members arranged along a belt width and extending longitudinally along a length of the belt, a jacket at least partially enclosing the plurality of tension members, the jacket defining a side of the belt configured to interface with the sheave, and a plurality of tracking features extending from the side of the belt. The plurality of tracking features are laterally spaced across the belt width. Each tracking feature is configured to be received in a tracking groove of the plurality of tracking grooves, and each tension member is laterally offset from each of the tracking features of the plurality of tracking features.

Additionally or alternatively, in this or other embodiments a sheave surface is defined between adjacent tracking grooves of the plurality of tracking grooves, and a tracking feature gap is defined between adjacent tracking features.

Additionally or alternatively, in this or other embodiments each tension member of the plurality of tension members is located over a sheave surface of the plurality of sheave surfaces.

Additionally or alternatively, in this or other embodiments the debris channel is positioned radially inward of the radial extent of the corresponding tracking feature.

Additionally or alternatively, in this or other embodiments the tracking groove is substantially triangular in cross-sectional shape.

Additionally or alternatively, in this or other embodiments the tracking feature is substantially triangular in cross-sectional shape.

Additionally or alternatively, in this or other embodiments the plurality of tracking features are formed from a first material, and the jacket is formed from a second material different from the first material.

Additionally or alternatively, in this or other embodiments the first material has a lower coefficient of friction than the second material.

Additionally or alternatively, in this or other embodiments a tracking groove of the plurality of tracking grooves has a lower coefficient of friction than the sheave surface.

Additionally or alternatively, in this or other embodiments a cleaning element is insertable into the debris channel configured to remove accumulated debris from the debris channel.

In another embodiment, an elevator system includes a hoistway, an elevator car located in the hoistway and movable therein, a sheave including a plurality of tracking grooves laterally spaced across a sheave width, and a debris channel located in a tracking groove of the plurality of tracking grooves, defining a radially inwardmost extent of the tracking groove. A belt is operably connected to the elevator car to suspend and/or drive the elevator car along the hoistway, the belt including a plurality of tension members arranged along a belt width and extending longitudinally along a length of the belt, a jacket at least partially enclosing the plurality of tension members, the jacket defining a side of the belt configured to interface with the sheave, and a plurality of tracking features extending from the side of the belt, the plurality of tracking features laterally spaced across the belt width. Each tracking feature is configured to be received in a tracking groove of the plurality of tracking grooves, and each tension member is laterally offset from each of the tracking features of the plurality of tracking features.

Additionally or alternatively, in this or other embodiments a sheave surface is defined between adjacent tracking grooves of the plurality of tracking grooves, and a tracking feature gap is defined between adjacent tracking features.

Additionally or alternatively, in this or other embodiments each tension member of the plurality of tension members is located over a sheave surface of the plurality of sheave surfaces.

Additionally or alternatively, in this or other embodiments the debris channel is located radially inward of the radial extent of the corresponding tracking feature.

Additionally or alternatively, in this or other embodiments the tracking groove is substantially triangular in cross-sectional shape.

Additionally or alternatively, in this or other embodiments the tracking feature is substantially triangular in cross-sectional shape.

Additionally or alternatively, in this or other embodiments the plurality of tracking features are formed from a first material, and the jacket is formed from a second material different from the first material, the first material having a lower coefficient of friction than the second material.

Additionally or alternatively, in this or other embodiments a cleaning element is insertable into the debris channel configured to remove accumulated debris from the debris channel.

In yet another embodiment, a sheave for an elevator system includes a plurality of tracking grooves laterally spaced across a sheave width and a debris channel located in a tracking groove of the plurality of tracking grooves, defining a radially inwardmost extent of the tracking groove. Each tracking groove of the plurality of tracking grooves is configured to receive a corresponding tracking feature of a belt of an elevator system.

Additionally or alternatively, in this or other embodiments a sheave surface is defined between adjacent tracking grooves of the plurality of tracking grooves.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
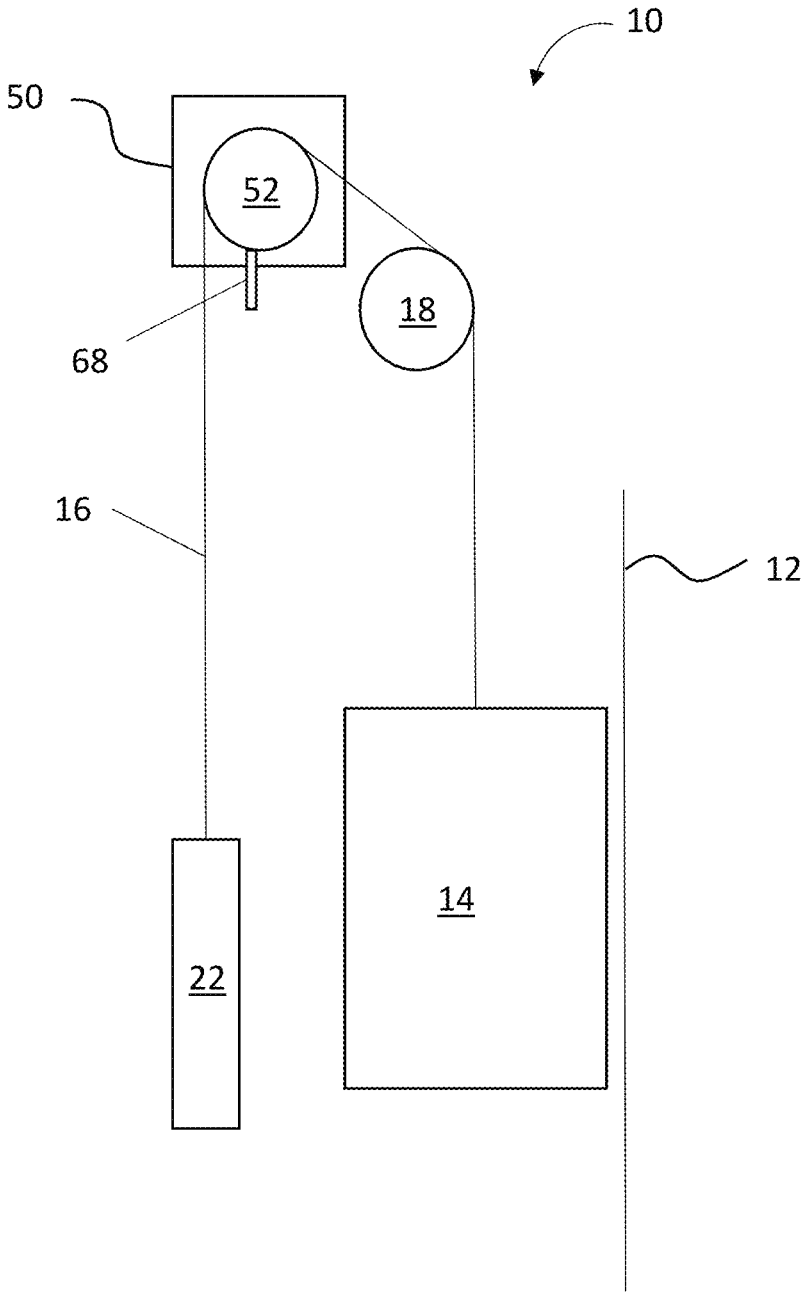
FIG. 1 is a schematic illustration of an embodiment of an elevator system.

Shown in FIG. 1 is a schematic view of an exemplary traction elevator system 10. Features of the elevator system 10 that are not required for an understanding of the present invention (such as the guide rails, safeties, etc.) are not discussed herein. The elevator system 10 includes an elevator car 14 operatively suspended or supported in a hoistway 12 with one or more belts 16. The one or more belts 16 interact with sheaves 18 and 52 to be routed around various components of the elevator system 10. Sheave 18 is configured as a diverter, deflector or idler sheave and sheave 52 is configured as a traction sheave 52, driven by a machine 50. Movement of the traction sheave 52 by the machine 50 drives, moves and/or propels (through traction) the one or more belts 16 that are routed around the traction sheave 52. Diverter, deflector or idler sheaves 18 are not driven by a machine 50, but help guide the one or more belts 16 around the various components of the elevator system 10. The one or more belts 16 could also be connected to a counterweight 22, which is used to help balance the elevator system 10 and reduce the difference in belt tension on both sides of the traction sheave during operation. The sheaves 18 and 52 each have a diameter, which may be the same or different from each other.

In some embodiments, the elevator system 10 could use two or more belts 16 for suspending and/or driving the elevator car 14 In addition, the elevator system 10 could have various configurations such that either both sides of the one or more belts 16 engage the sheaves 18, 52 or only one side of the one or more belts 16 engages the sheaves 18, 52. The embodiment of FIG. 1 shows a 1:1 roping arrangement in which the one or more belts 16 terminate at the car 14 and counterweight 22, while other embodiments may utilize other roping arrangements.

The belts 16 are constructed to meet belt life requirements and have smooth operation, while being sufficiently strong to be capable of meeting strength requirements for suspending and/or driving the elevator car 14 and counterweight 22.

Figure 2:
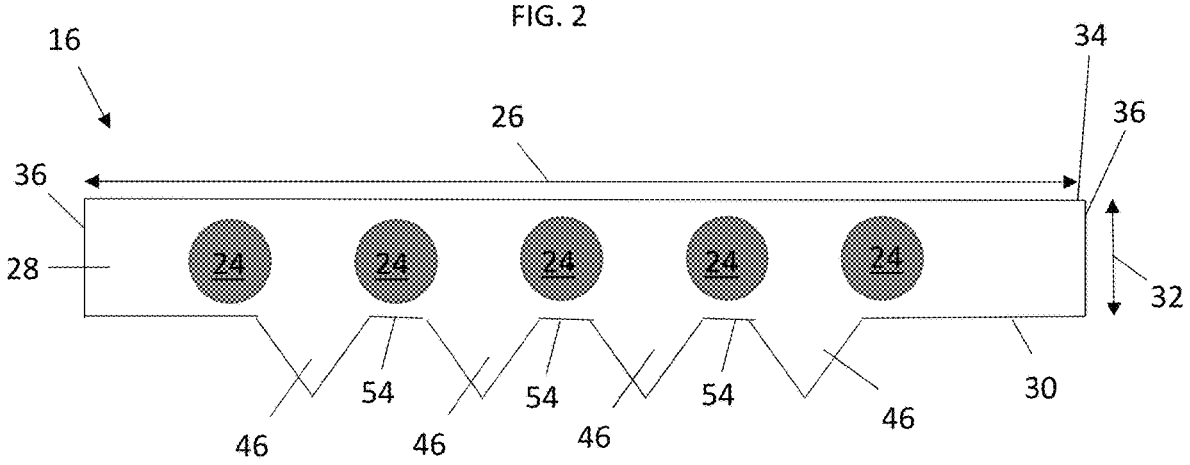
FIG. 2 is cross-sectional view of an embodiment of a belt for an elevator system.

FIG. 2 provides a cross-sectional schematic of an exemplary belt 16 construction or design. The belt 16 includes a plurality of tension members 24 extending longitudinally along the belt 16 and arranged across a belt width 26. The tension members 24 are at least partially enclosed in a jacket material 28 to restrain movement of the tension members 24 in the belt 16 and to protect the tension members 24. The jacket material 28 defines a traction side 30 configured to interact with a corresponding surface of the traction sheave 52. Exemplary materials for the jacket material 28 include the elastomers of thermoplastic and thermosetting polyurethanes, thermoplastic polyester elastomers, ethylene propylene diene elastomer, chloroprene, chlorosulfonyl polyethylene, ethylene vinyl acetate, polyamide, polypropylene, butyl rubber, acrylonitrile butadiene rubber, styrene butadiene rubber, acrylic elastomer, fluoroelastomer, silicone elastomer, polyolefin elastomer, styrene block and diene elastomer, natural rubber, or combinations thereof. Other materials may be used to form the jacket material 28 if they are adequate to meet the required functions of the belt 16. For example, a primary function of the jacket material 28 is to provide a sufficient coefficient of friction between the belt 16 and the traction sheave 52 to produce a desired amount of traction therebetween. The jacket material 28 should also transmit the traction loads to the tension members 24. In addition, the jacket material 28 should be wear resistant and protect the tension members 24 from impact damage, exposure to environmental factors, such as chemicals, for example.

The belt 16 has a belt width 26 and a belt thickness 32, with an aspect ratio of belt width 26 to belt thickness 32 greater than one. The belt 16 further includes a back side 34 opposite the traction side 30 and belt edges 36 extending between the traction side 30 and the back side 34. While five tension members 24 are illustrated in the embodiment of FIG. 2, other embodiments may include other numbers of tension members 24, for example, 6, 10 or 12 tension members 24. Further, while the tension members 24 of the embodiment of FIG. 2 are substantially identical, in other embodiments, the tension members 24 may differ from one another.

Figure 3A:
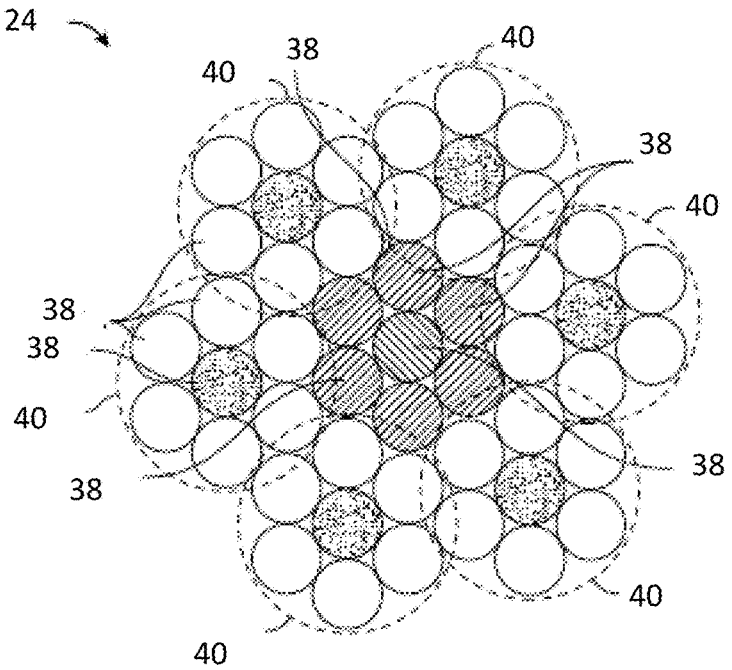
FIG. 3A is a cross-sectional view of an embodiment of a tension member of a belt.
Figure 3B:
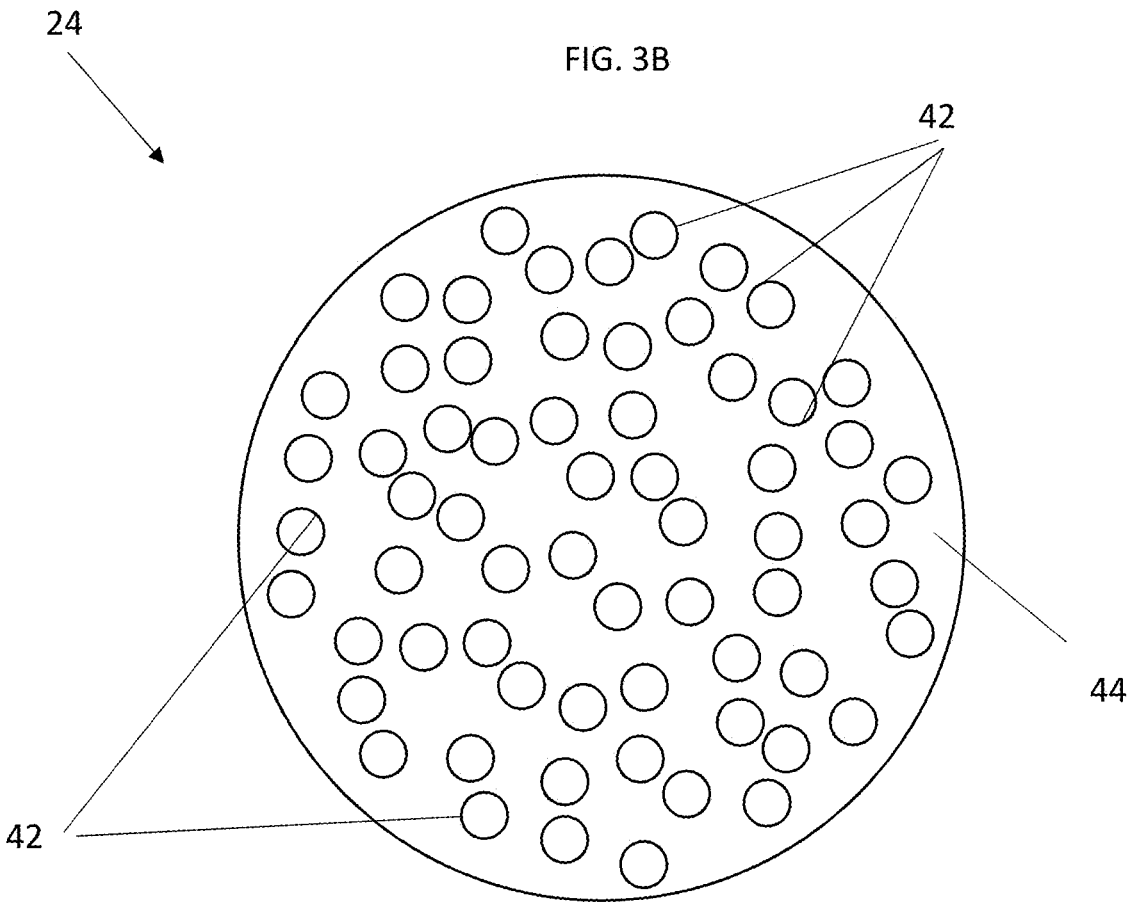
FIG. 3B is a cross-sectional view of another embodiment of a tension member of a belt.

Referring now to FIG. 3A, the tension member 24 may be a plurality of wires 38, for example, steel wires 38, which in some embodiments are formed into one or more strands 40. In other embodiments, such as shown in FIG. 3B, the tension member 24 may include a plurality of fibers 42, such as carbon fiber, glass fiber or aramid fiber, disposed in a matrix material 44. Materials such as polyurethane, vinylester, or epoxy may be utilized as the matrix material.

Referring again to FIG. 2, the belt 16 includes one or more tracking features 46 at the traction side 30. In some embodiments, such as shown in FIG. 2, the tracking features 46 are protrusions from the traction side 30, and may be triangular in shape as shown. It is to be appreciated, however, that while triangular-shaped tracking features are shown in FIG. 2, other shapes such as, for example, semi-circular or trapezoidal may be utilized. Further, while in the embodiment shown the tracking features 46 are located at the traction side 30, in other embodiments the tracking features 46 are alternatively or additionally located at the back side 34. The tracking features 46 may be formed with the jacket material 28 from the same material via, for example, an extrusion process. In other embodiments, the tracking features 46 may be formed from a material different from that of the jacket material 28 for, for example, improved wear resistance, stiffness or durability. For example, the tracking features 46 may be formed from material having a lower coefficient of friction than a coefficient of friction of the jacket material 28. The tracking features 46 may be co-extruded with the jacket material 28, or may alternatively formed separately and adhered or otherwise secured to the traction side 30. The tracking features 46 are arrayed across the belt width 26, and are spaced apart by a tracking feature gap 54, defined as a distance along the traction side 30 between adjacent tracking features 46. In some embodiments, the tracking features 46 and tension members 24 are positioned such that the tracking features are 46 are located laterally between adjacent tension members 24 and over the tracking feature gaps 54, with the tension member 24 centered over its corresponding tracking feature gap 54. Further, the tracking features 46 may be evenly spaced across the belt width 26, or in some embodiments may have unequal lateral spacing to provide improved tracking at certain portions of the belt 16, such as nearer the lateral ends of the belt 16. In other embodiments, the tension members 24 are located over the tracking features 46, rather than over the tracking feature gaps 54.

Figure 4:
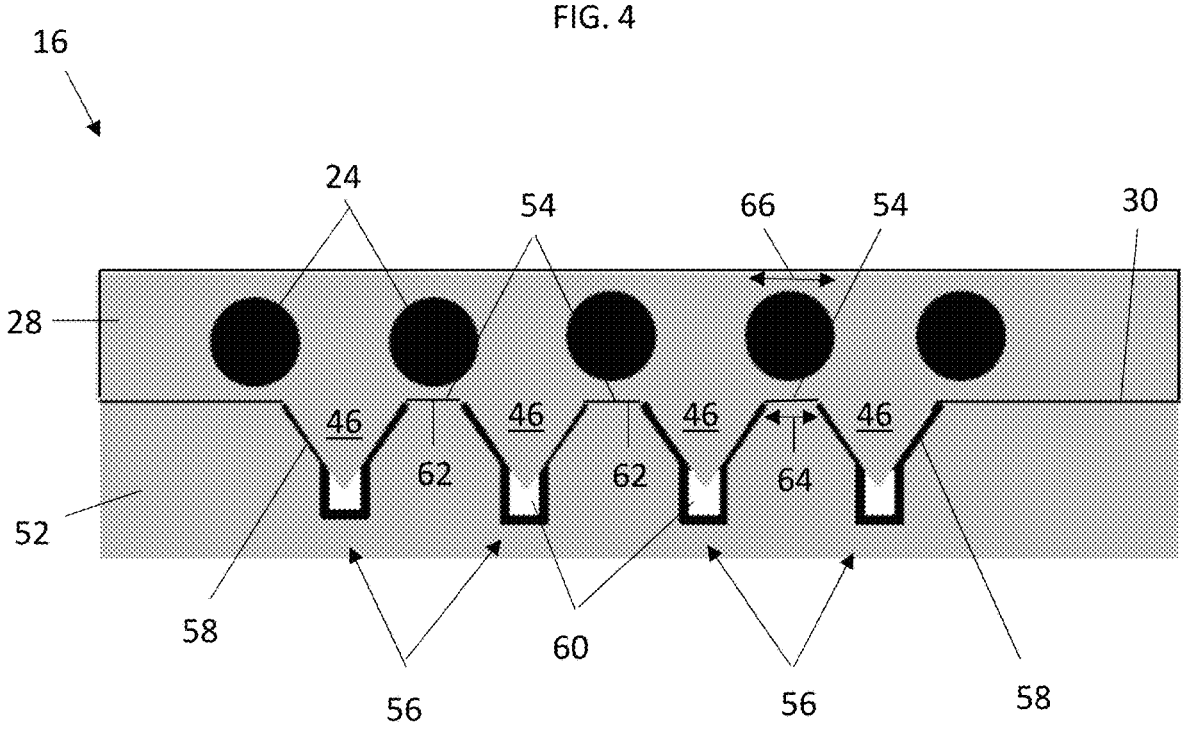
FIG. 4 is a cross-sectional view of an embodiment of an elevator belt and sheave interface at the sheave.

Referring now to FIG. 4, the traction sheave 52 includes complimentary tracking grooves 56 to receive the tracking features 46 of the belt 16. In other embodiments, tracking grooves 56 may be disposed at another sheave 18 of the elevator system 10, such as a deflector and/or idler sheave 18. In the embodiment of FIG. 4, the tracking grooves 56 each include a V-shaped groove portion 58 in which the tracking features 46 are positioned. One skilled in the art will appreciate, however, that the tracking grooves 56 may be otherwise shaped to receive tracking features 46 of shapes other than triangular. The tracking grooves 56 each further include a debris channel 60 located at a radially inwardmost extent of the tracking groove 56. The debris channel 60 is configured to collect wear debris and external debris such as deposited dust from the belt 16, and in particular from the tracking features 46 and the traction side 30 as they pass over the traction sheave 52. In some embodiments the debris channel 60 has a rectangular cross-sectional shape, but in other embodiments other cross-sectional shapes such as triangular or circular may be utilized. Referring to FIG. 1, a cleaning element 68, such as a brush, rod, finger or other element, is inserted into the debris channel 60, at a sheave position away from the belt 16 to remove accumulated debris from the debris channel 60. Such debris removal As can be seen in FIG. 4, the tracking grooves 56 are laterally spaced across the traction sheave 52 with a sheave surface 62 defined between adjacent tracking grooves 56. The sheave surfaces 62 are positioned below the tension members 24 of the belt 16, and in some embodiments have a surface width 64 smaller than a tension member width 66. Further, in some embodiments, the surface width 64 is between ¼ and ¾ of the tension member width 66. The sheave surface 62 may be substantially flat, or alternatively may be shaped to match an outer surface of the tension member 24. Further, in some embodiments, the tracking grooves 46 may have a lower coefficient of friction than the sheave surface 62. This may be achieved through, for example, the use of coatings or other surface finishes.

Figure 5:
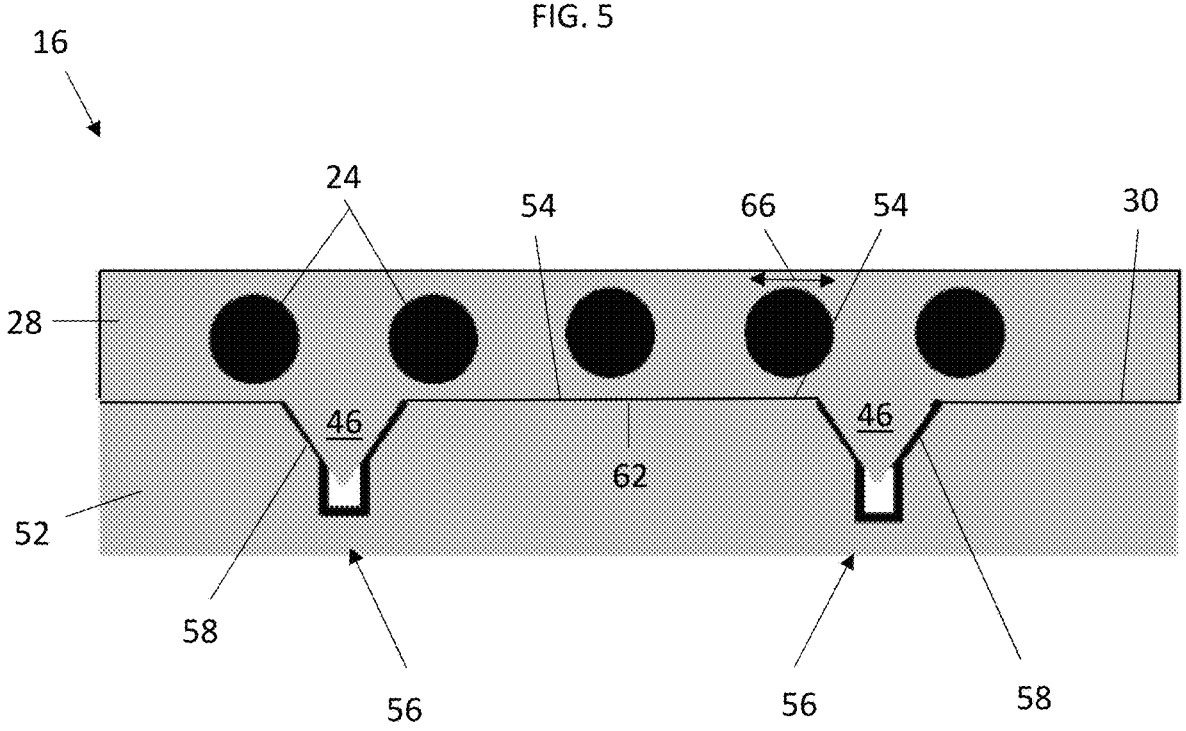
FIG. 5 is a cross-sectional view of another embodiment of an elevator belt and sheave interface at the sheave.

In another embodiment, shown in FIG. 5, the sheave surface 62 may extend continuously under two or more tension members 24, such as at a centermost section of the traction sheave 52, while tracking grooves 56 are located at an edge portion laterally outboard of the centermost section. In some embodiments, tension members 24 may be unequal in effective diameter. For example, tension members 24 located at the centermost section may have a greater effective diameter than tension members 24 located at the edge portion.

Figure 6:
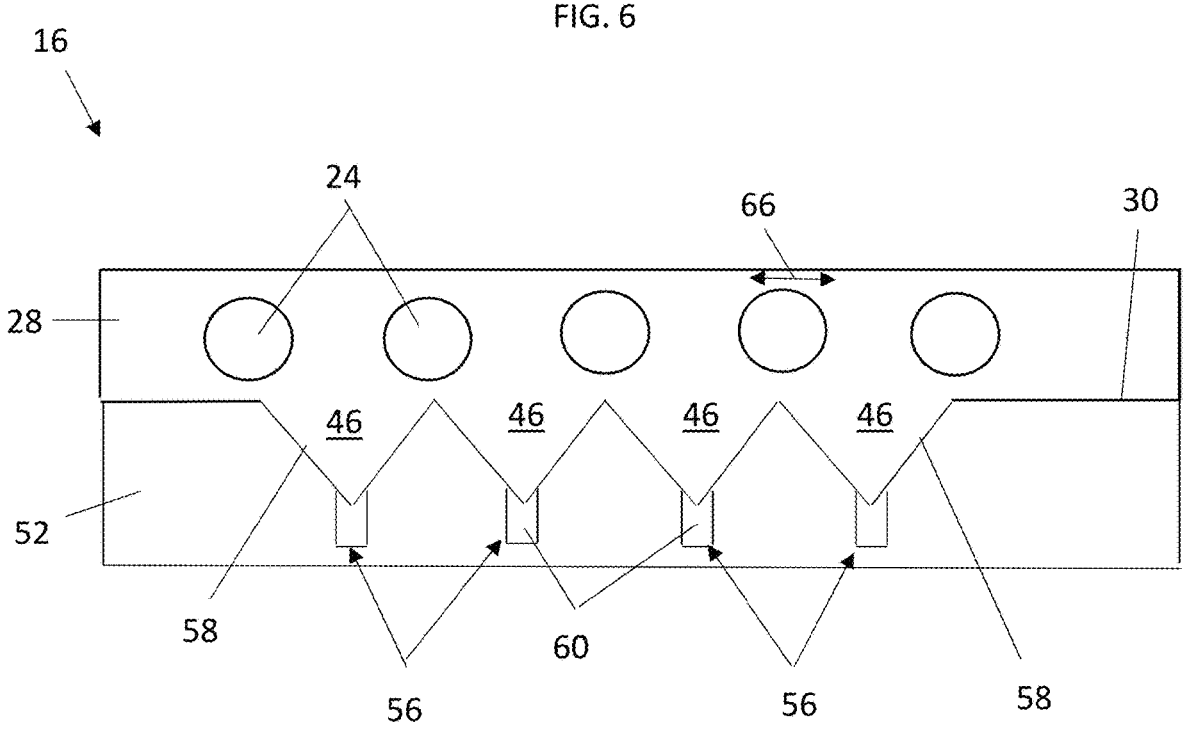
FIG. 6 is a cross-sectional view of yet another embodiment of an elevator belt and sheave interface at the sheave.

In yet another embodiment, illustrated in FIG. 6, laterally adjacent tracking features 46 substantially abut one another such that the belt 16 does not include a tracking feature gap 54 between the adjacent tracking features 46. Likewise, the traction sheave 52, and/or deflector and/or idler sheave 18, includes adjacent tracking grooves 56, which substantially abut one another, such that the sheave 18/52 is absent a sheave surface 62 between the adjacent tracking grooves 56. In the embodiment of FIG. 6, the tension members 24 are arranged such that a lateral center of each tension member 24 is laterally offset from a lateral center of each of the tracking features 46 in a belt width 26 direction.

The arrangements disclosed herein ensure tight spacing of the belts 16 on the traction sheave 52 in elevator systems 10 where multiple belts 16 are utilized, and reduces an overall drive sheave 52 width. Further, since the tension members 24 are well supported by the sheave surfaces 62, loading of the tracking features 46 of the belt 16 is reduced, improving wear performance of the belt 16 and reducing a susceptibility to belt split between the tension members 24.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A belt and sheave assembly for an elevator system, comprising:

a sheave including:

a plurality of tracking grooves laterally spaced across a sheave width; and a debris channel extending from a radially inwardmost extent of a tracking groove of the plurality of tracking grooves, the tracking groove having a first cross-sectional shape, and the debris channel having a second cross-sectional shape different from the first cross-sectional shape; and a belt including:

a plurality of tension members arranged along a belt width and extending longitudinally along a length of the belt;

a jacket at least partially enclosing the plurality of tension members, the jacket defining a side of the belt configured to interface with the sheave; and a plurality of tracking features extending from the side of the belt, the plurality of tracking features laterally spaced across the belt width;

wherein each tracking feature is configured to be received in a tracking groove of the plurality of tracking grooves;

wherein each tension member is laterally offset from each of the tracking features of the plurality of tracking features; and wherein the jacket is formed from a first material and the plurality of tracking features are formed from a second material different from the first material;

wherein a tracking feature of the plurality of tracking features extends partially into the debris channel.

2. The assembly of claim 1, wherein:

a sheave surface is defined between adjacent tracking grooves of the plurality of tracking grooves; and a tracking feature gap is defined between adjacent tracking features.

3. The assembly of claim 2, wherein each tension member of the plurality of tension members is located over a sheave surface of the plurality of sheave surfaces.

4. The assembly of claim 2, wherein a tracking groove of the plurality of tracking grooves has a lower coefficient of friction than the sheave surface.

5. The assembly of claim 1, wherein the debris channel is disposed radially inward of the radial extent of the corresponding tracking feature.

6. The assembly of claim 1, wherein the tracking groove is substantially triangular in cross-sectional shape.

7. The assembly of claim 6, wherein the tracking feature is substantially triangular in cross-sectional shape.

8. The assembly of claim 1, further comprising a cleaning element insertable into the debris channel configured to remove accumulated debris from the debris channel.

9. An elevator system, comprising:

a hoistway;

an elevator car disposed in the hoistway and movable therein;

a sheave including:

a plurality of tracking grooves laterally spaced across a sheave width; and a debris channel extending from a radially inwardmost extent of a tracking groove of the plurality of tracking grooves, the tracking groove having a first cross-sectional shape, and the debris channel having a second cross-sectional shape different from the first cross-sectional shape; and a belt operably connected to the elevator car to suspend and/or drive the elevator car along the hoistway, the belt including:

a plurality of tension members arranged along a belt width and extending longitudinally along a length of the belt;

a jacket at least partially enclosing the plurality of tension members, the jacket defining a side of the belt configured to interface with the sheave; and a plurality of tracking features extending from the side of the belt, the plurality of tracking features laterally spaced across the belt width;

wherein each tracking feature is configured to be received in a tracking groove of the plurality of tracking grooves;

wherein each tension member is laterally offset from each of the tracking features of the plurality of tracking features; and wherein the jacket is formed from a first material and the plurality of tracking features are formed from a second material different from the first material;

wherein a tracking feature of the plurality of tracking features extends partially into the debris channel.

10. The elevator system of claim 9, wherein:

a sheave surface is defined between adjacent tracking grooves of the plurality of tracking grooves; and a tracking feature gap is defined between adjacent tracking features.

11. The assembly of claim 10, wherein each tension member of the plurality of tension members is located over a sheave surface of the plurality of sheave surfaces.

12. The elevator system of claim 9, wherein the debris channel is disposed radially inward of the radial extent of the corresponding tracking feature.

13. The elevator system of claim 9, wherein the tracking groove is substantially triangular in cross-sectional shape.

14. The elevator system of claim 13, wherein the tracking feature is substantially triangular in cross-sectional shape.

15. The elevator system of claim 9, further comprising a cleaning element insertable into the debris channel configured to remove accumulated debris from the debris channel.

* * * * *